US009484657B2

(12) United States Patent
Martin et al.

(10) Patent No.: US 9,484,657 B2
(45) Date of Patent: Nov. 1, 2016

(54) HARNESS CONNECTOR HAVING A POWER AND SIGNAL CARTRIDGES

(71) Applicant: Tyco Electronics Corporation, Berwyn, PA (US)

(72) Inventors: Galen M. Martin, Camp Hill, PA (US); Samuel Garner Bouse, Jr., Huntsville, AL (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/547,348

(22) Filed: Nov. 19, 2014

(65) Prior Publication Data

US 2016/0141786 A1 May 19, 2016

(51) Int. Cl.

| | |
|---|---|
| ***H01R 25/00*** | (2006.01) |
| ***H01R 13/422*** | (2006.01) |
| ***H01R 13/436*** | (2006.01) |
| ***H01R 13/514*** | (2006.01) |
| ***H01R 13/518*** | (2006.01) |
| *H01R 13/627* | (2006.01) |

(52) U.S. Cl.

CPC ..... *H01R 13/4223* (2013.01); *H01R 13/4361* (2013.01); *H01R 13/514* (2013.01); *H01R 13/518* (2013.01); *H01R 13/6272* (2013.01); *H01R 2201/26* (2013.01)

(58) Field of Classification Search

CPC ..... H01R 13/4223; H01R 13/514; H01R 25/006; H01R 13/006; H01R 13/506; H01R 12/716

USPC ..... 439/638

See application file for complete search history.

(56) References Cited

U.S. PATENT DOCUMENTS

| | | | | |
|---|---|---|---|---|
| 5,286,210 A * | 2/1994 | Kilsdonk | H01R 13/514 439/638 |
| 5,419,717 A * | 5/1995 | Abendschein | G02B 6/3817 385/139 |
| 5,454,733 A * | 10/1995 | Watanabe | H01R 13/514 439/540.1 |
| 5,882,220 A * | 3/1999 | Horii | G06F 1/1632 361/679.41 |
| 6,080,011 A * | 6/2000 | Tsao | H01R 13/514 439/540.1 |

(Continued)

FOREIGN PATENT DOCUMENTS

| | | |
|---|---|---|
| DE | 34 42 056 A1 | 5/1986 |
| DE | 298 12 500 U1 | 9/1998 |

(Continued)

OTHER PUBLICATIONS

European Search Report, EP 15 19 5190, Mail Date, Mar. 17, 2016, Application No. 15195190.2-1801.

*Primary Examiner* — Jean F Duverne

(57) ABSTRACT

A harness connector includes a harness housing having a signal cavity and a power cavity defined by housing walls. At least one of the housing walls has a locking rail extending therefrom into the corresponding signal cavity or power cavity. Signal harness cartridges are received in the signal cavity, each holding a plurality of signal terminals. Each signal harness cartridge has a locking slot configured to receive a corresponding locking rail in a position directly behind the signal terminals to secure the signal terminals in the signal harness cartridge. A power harness cartridge is received in the power cavity that holds a plurality of power terminals. The power harness cartridge has a locking slot configured to receive a corresponding locking rail in a position directly behind the power terminals to secure the power terminals in the power harness cartridge.

20 Claims, 4 Drawing Sheets

(56) References Cited

U.S. PATENT DOCUMENTS 6,540,563 B1 * 4/2003 Hu ..... H01R 12/716 439/541.5
6,692,311 B1 * 2/2004 Kamei ..... H01R 9/2458 439/218
6,702,610 B2 * 3/2004 Zheng ..... H01R 13/506 439/441
6,857,900 B2 * 2/2005 Kleeberger ..... H01R 13/6215 385/76
7,445,551 B1 * 11/2008 Okada ..... A63F 13/08 463/43
8,033,837 B2 * 10/2011 Yang ..... H01R 12/724 439/607.4
2003/0070968 A1 * 4/2003 Haynes ..... B01D 35/143 210/87
2003/0194914 A1 10/2003 Duck et al.
2006/0052006 A1 * 3/2006 Amano ..... H01R 12/725 439/638
2006/0063434 A1 * 3/2006 Bergmann ..... H01R 25/006 439/638
2007/0128945 A1 * 6/2007 Huang ..... H01R 31/00 439/638
2012/0056954 A1 * 3/2012 Asauchi ..... B41J 2/17513 347/86
2013/0203299 A1 8/2013 Wilkner
2014/0123837 A1 * 5/2014 Hummel ..... G10H 1/342 84/622
2015/0179158 A1 * 6/2015 Hummel ..... G10H 3/00 84/626
2015/0333441 A1 * 11/2015 Annis ..... H01R 13/62911 439/133

FOREIGN PATENT DOCUMENTS

DE 202 05 787 U1 7/2002
DE 10 2010 041451 A1 3/2012

* cited by examiner

HARNESS CONNECTOR HAVING A POWER AND SIGNAL CARTRIDGES

BACKGROUND OF THE INVENTION

The subject matter herein relates generally to harness assemblies having power and signal cartridges.

Automotive connector systems utilize harness connectors to convey both power and data signal. Existing harness connector designs utilize a connector housing with many individual terminal channels that hold individual terminals. Such connectors typically include separate components, known as an independent secondary locking device and a terminal position assurance device. These components are separately coupled to the connector housing and used to lock the terminals in the connector housing and assure that the terminals are properly positioned in the connector housing. One problem with known harness connectors is that as requirements or configurations change, new connectors are designed and developed. For example, when a different number of power and signal conductors are required or when a different current carrying capacity is needed, an entirely new connector is designed and tooled. The capital investment for tooling is expensive.

A need remains for a harness connector having reduced manufacturing complexity and cost of assembly with an increase in the quality of harness connector.

BRIEF DESCRIPTION OF THE INVENTION

In one embodiment, a harness connector is provided that includes a harness housing having a signal cavity and a power cavity defined by housing walls. At least one of the housing walls has a locking rail extending therefrom into the corresponding signal cavity or power cavity. A plurality of signal harness cartridges are received in the signal cavity. Each signal harness cartridge holds a plurality of signal terminals terminated to ends of signal cables. Each signal harness cartridge has a locking slot configured to receive a corresponding locking rail in a position directly behind the signal terminals to secure the signal terminals in the signal harness cartridge. A power harness cartridge is received in the power cavity. The power harness cartridge holds a plurality of power terminals terminated to ends of power cables. The power harness cartridge has a locking slot configured to receive a corresponding locking rail in a position directly behind the power terminals to secure the power terminals in the power harness cartridge.

In a further embodiment, a harness connector is provided that includes a harness housing having a signal cavity and a power cavity defined by housing walls. The harness housing has a signal locking rail extending from the corresponding housing wall into the signal cavity. The harness housing has a power locking rail extending from the corresponding housing wall into the power cavity. A plurality of signal harness cartridges are received in the signal cavity and arranged side-by-side. Each signal harness cartridge holds a plurality of signal terminals terminated to ends of signal cables. Each signal harness cartridge has a first side and a second side. The first side has a signal locking rail extending outward therefrom. The second side has a signal locking slot configured to receive a corresponding signal locking rail from either the harness housing or the adjacent signal harness cartridge in a position directly behind the signal terminals to secure the signal terminals in the signal harness cartridge. A power harness cartridge is received in the power cavity. The power harness cartridge holds a plurality of power terminals terminated to ends of power cables. The power harness cartridge has a locking slot receiving the power locking rail in a position directly behind the power terminals to secure the power terminals in the power harness cartridge.

In a further embodiment, a harness connector is provided that includes a harness housing having a signal cavity and a power cavity defined by housing walls. The harness housing has a front wall forward of the signal cavity. The front wall has a plurality of signal terminal channels therethrough. A signal harness cartridge is received in the signal cavity. The signal harness cartridge holds a plurality of signal terminals terminated to ends of signal cables. The signal terminals are aligned with corresponding signal terminal channels and the signal terminal channels are configured to guide header terminals of a header connector into mating engagement with the signal terminals. The harness connector includes a first power harness cartridge holding a plurality of power terminals terminated to ends of power cables and a second power harness cartridge holding a plurality of power terminals terminated to ends of power cables. The power terminals of the second power harness cartridge have a different cumulative current carrying capacity than the power terminals of the first power harness cartridge. The power cavity selectively receives either the first power harness cartridge or the second power harness cartridge to change the current carrying capacity of the harness connector.

DETAILED DESCRIPTION OF THE INVENTION

Embodiments described herein include a connector system having harness connectors. The harness connectors have both a power interface and a signal interface for transmitting power and data signals, respectively. Embodiments described herein have features that allow for a modular design of the harness connectors. The harness connectors include cartridges that may be interchanged within the harness connector to change the interface of the harness connector. The cartridges may be dedicated signal cartridges and dedicated power cartridges. The current carrying capacity of the harness connector may be changed by swapping out the power cartridge for a power cartridge having a different current carrying capacity. Embodiments described herein have features that guide the cartridges into position within the harness housing. Embodiments described herein provide secondary locking for terminals in the harness connector.

Figure 1:
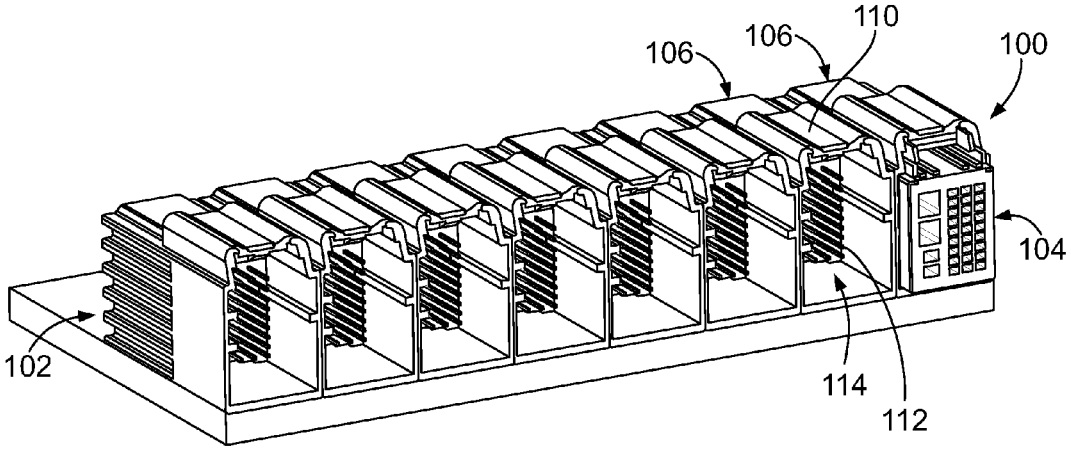
FIG. 1 illustrates a connector system formed in accordance with an exemplary embodiment showing a harness connector mated with a header connector of a header assembly.

FIG. 1 illustrates a connector system 100 formed in accordance with an exemplary embodiment, showing a header assembly 102 that is configured to be mated with corresponding harness connectors 104. The header assembly 102 includes a plurality of header connectors 106 matable with corresponding harness connectors 104 (only one shown in FIG. 1). The header assembly 102 is mounted to a circuit board, however may alternatively be a cable connector terminated to ends of cables. The harness connector 104 is a cable connector with a plurality of cables (only one shown in FIG. 1) of a harness extending therefrom terminated to corresponding harness terminals.

The header connectors 106 each include a header housing 110 holding a plurality of header terminals 112. The header terminals 112 may be pin terminals; however other types of terminals may be used in alternative embodiments. Optionally, the header terminals 112 may be part of header cartridges that are received in the header housing 110. The header housing 110 includes a cavity 114 that receives the corresponding harness connector 104. The header terminals 112 are exposed within the cavity 114 for mating with the harness connector 104.

Figure 2:
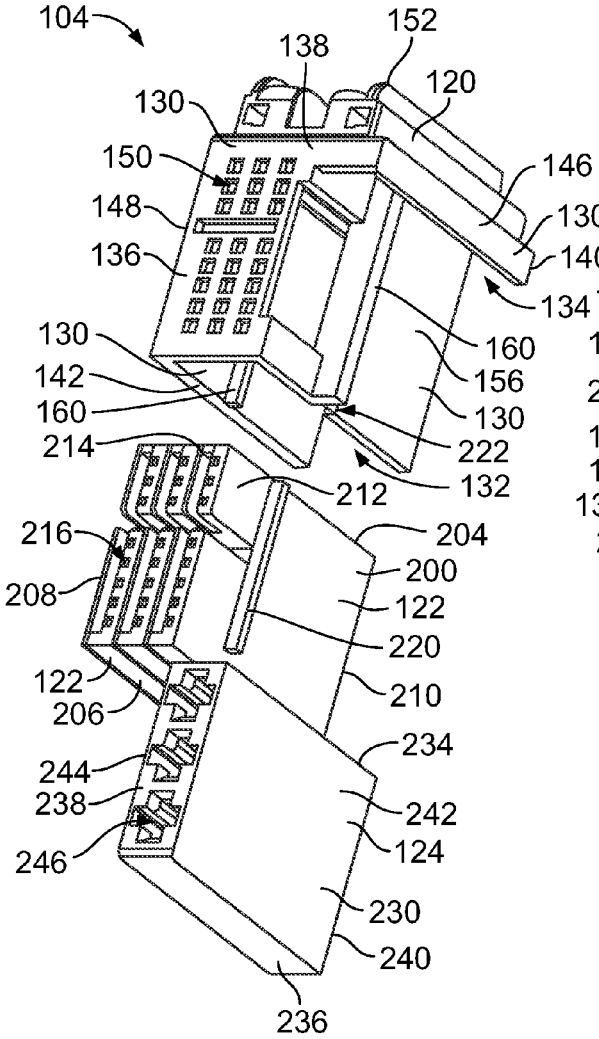
FIG. 2 is an exploded perspective view of the harness connector in accordance with an exemplary embodiment.
Figure 3:
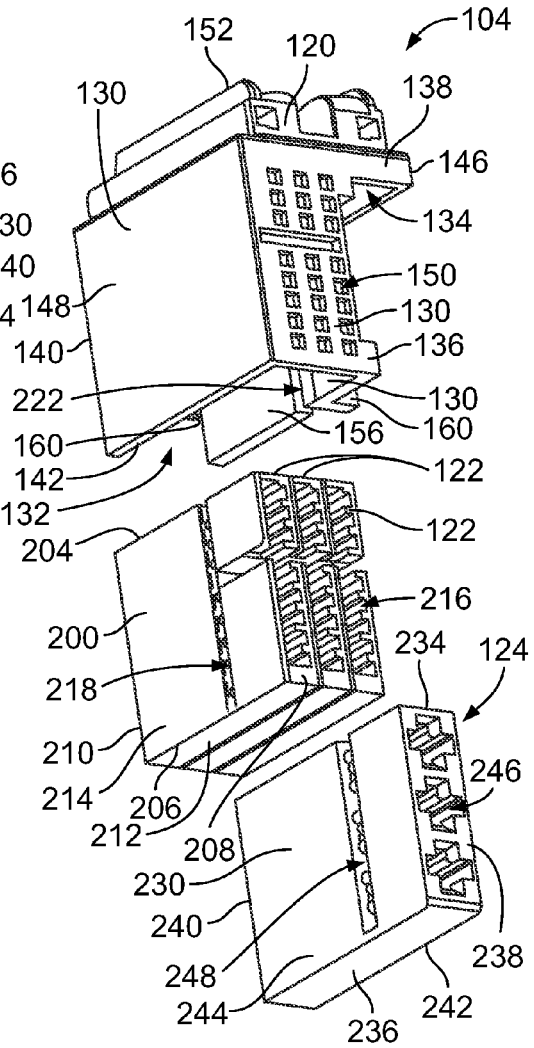
FIG. 3 is another exploded perspective view of the harness connector shown in FIG. 2.
Figure 5:
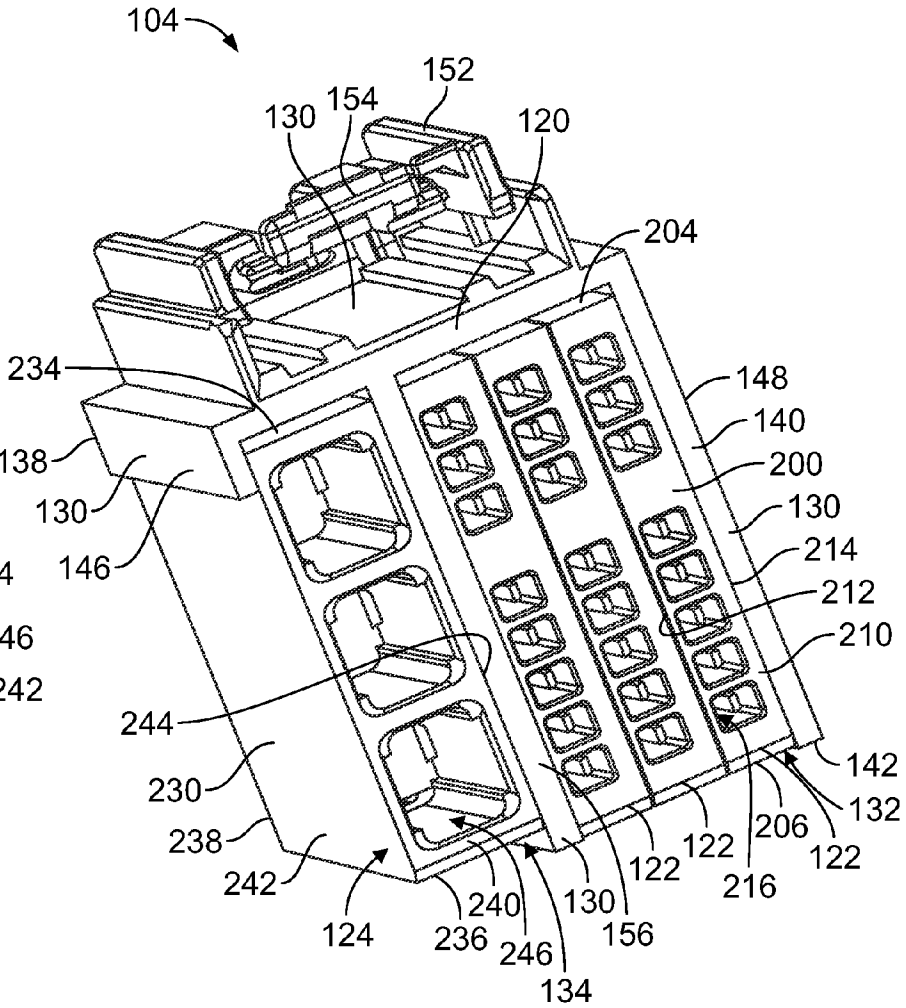
FIG. 5 is an assembled rear perspective view of the harness connector.
Figure 4:
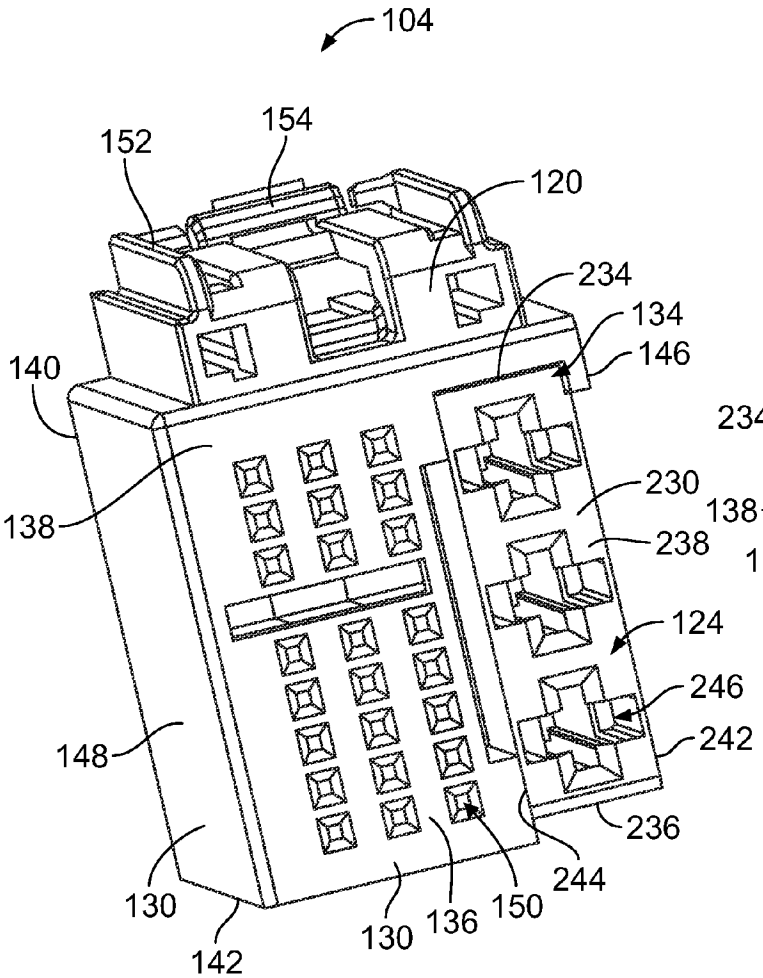
FIG. 4 is an assembled front perspective view of the harness connector.

FIGS. 2 and 3 are exploded, right and left perspective views of the harness connector 104 in accordance with an exemplary embodiment. FIG. 4 is an assembled front perspective view of the harness connector 104. FIG. 5 is an assembled rear perspective view of the harness connector 104.

The harness connector 104 includes a harness housing 120 and a plurality of harness cartridges 122, 124. The harness cartridges 122, 124 hold a plurality of harness terminals (shown in FIG. 6), which are more specifically identified as harness signal terminals 126 (shown in FIG. 6) and harness power terminals 128 (shown in FIG. 6) for transmitting data signals and power, respectively, with the header connector 106 (shown in FIG. 1). Other types of harness terminals may be used in addition to the signal and power terminals 126, 128, such as ground terminals (not shown). Optionally, each of the power terminals 128 may be held together in a common harness cartridge 124, also referred to as a power harness cartridge 124. The signal terminals 126 may be held together in dedicated signal harness cartridges, which may be referred to hereinafter as signal harness cartridges 122. Alternatively, any of the harness cartridges 122 and/or 124 may have both signal and power terminals 126, 128, or other types of terminals.

Any number of signal harness cartridges 122 may be loaded into the harness housing 120 depending on the particular application. Any number of power harness cartridges 124 may be loaded into the harness housing 120 depending on the particular application, although the embodiments illustrated herein show a single power harness cartridge 124. Having the harness power terminals 128 and the harness signal terminals 126 held by a common harness housing 120 allows both the harness power terminals 128 and the harness signal terminals 126 to be mated during a common mating process to the header connector 106.

The harness housing 120 has a plurality of housing walls 130 defining a signal cavity 132 and a power cavity 134. Optionally, the harness housing 120 may be generally rectangular in shape; however other shapes are possible in alternative embodiments. The housing walls 130 may define a generally rectangular signal cavity 132 and a generally rectangular power cavity 134; however other shaped cavities are possible in alternative embodiments.

The housing walls 130 include a front wall 136 at a front 138 of the harness housing 120. The front wall 136 may cover the front of the signal cavity 132 and/or the power cavity 134. In the illustrated embodiment, the front wall 136 covers the front of the signal cavity 132 but the front of the power cavity 134 is open. The signal and power cavities 132, 134 are open at a rear 140 of the harness housing 120. The signal and power cavities 132, 134 are open at a bottom 142 of the harness housing 120 for receiving the harness cartridges 122, 124 through the open bottom 142. The harness housing 120 includes opposed sides 146, 148 defined by corresponding side housing walls 130.

In an exemplary embodiment, the front wall 136 includes a plurality of front terminal channels 150 therethrough. When the signal harness cartridges 122 are positioned behind the front wall 136, the front terminal channels 150 are aligned with corresponding signal terminals 126. The front terminal channels 150 guide mating of the header terminals 112 with the harness connector 104 when the harness connector 104 is loaded into the cavity 114. The front terminal channels 150 may have lead-in surfaces that register the header terminals 112 with the signal terminals 126 for proper mating and to reduce stubbing.

A top 152 of the harness housing 120 is closed and may include guide features for guiding the harness connector 104 into the cavity 114 (shown in FIG. 1) of the header connector 106. In an exemplary embodiment, the guide features on the top 152 of the harness housing 120 are used to guide alignment and mating with the header connector 106. In the illustrated embodiment, the guide features are defined by ribs or protrusions. The number of guide features and/or location of guide features may provide keying features for keyed mating with the corresponding header connector 106. The positions of the guide features may be different, such as when a different number of power terminals 128 and/or signal terminals 126 are used, which corresponds to a different type of harness connector 104 that needs to be mated with the particular header connector 106.

The harness housing 120 includes a latch 154 at the top 152 that is used for securing the harness connector 104 in the cavity 114. The latch 154 may be deflectable and releasable to allow the harness connector 104 to be released from the cavity 114. Other types of securing features, in various locations, may be used to retain the harness connector 104 in the header connector 106.

In an exemplary embodiment, the harness housing 120 includes a separating wall 156, which is one of the housing walls 130, which separates the signal cavity 132 from the power cavity 134. Optionally, the signal cavity 132 and/or the power cavity 134 may be divided into sub-cavities by additional separating walls. The separating wall 156 divides the signal cavity 132 from the power cavity 134. The signal cavity 132 receives corresponding signal harness cartridges 122. The power cavity 134 receives corresponding power harness cartridges 124.

The separating wall 156 is oriented generally parallel to and positioned between the housing walls 130 defining the first and second sides 146, 148. The power cavity 134 is defined between the separating wall 156 and the housing wall 130 at the first side 146. When the power harness cartridge 124 is loaded in the power cavity 134, the power harness cartridge 124 may engage the separating wall 156 and/or the first side 146, such as to hold the power harness cartridge 124. The signal cavity 132 is defined between the separating wall 156 and the housing wall 130 at the second side 148. Optionally, the plurality of signal harness cartridges 122 are arranged side-by-side in a stack and coupled together as a unit. When the unit or stack of signal harness cartridges 122 are loaded in the signal cavity 132, the outermost signal harness cartridges 122 may engage the separating wall 156 and/or the second side 148, such as to hold the signal harness cartridges 122.

In an exemplary embodiment, the harness housing 120 is configured to receive different types of signal and/or power harness cartridges 124, such as signal and/or power harness cartridges 124 having a different arrangement (e.g. number size, position) of terminals 126, 128. For example, the signal and/or power harness cartridges 124 may have the same outer dimensions, but the terminals 126, 128 inside may be different. The cavities 132, 134 are able to accommodate any of the different types of harness cartridges 122, 124. In a particular embodiment, the same harness housing 120 is able to accommodate different types of power harness cartridges 124, such as low power cartridges, medium power cartridges, or high power cartridges having relative low, medium, and high current carrying capabilities, respectively.

In an exemplary embodiment, at least one of the housing walls 130 includes a locking rail 160 extending into the corresponding signal cavity 132 and/or power cavity 134. The locking rails 160 interoperate (e.g., are received within) with the corresponding signal harness cartridge(s) 122 and power harness cartridge(s) 124 to lock the harness terminals 126, 128 therein. The locking rails 160 are protrusions or extensions that extend outward from the corresponding housing wall 130 into the corresponding cavity 132, 134. The locking rails 160 may be elongated and may extend vertically for any desired length between the top and the bottom (e.g., parallel to the front 138 and/or the sides 146, 148. The locking rails 160 may be rectangular in cross-section, or alternatively may have any desired shape for serving the desired locking function.

In the illustrated embodiment, the housing wall 130 at the second side 148 includes a signal locking rail 160 extending into the signal cavity 132 and the separating wall 156 includes a power locking rail 160 extending into the power cavity 134. Other arrangements of the locking rails 160 are possible in alternative embodiments. For example, in one particular embodiment, the separating wall 156 may include locking rails 160 on both sides that extend into both the signal cavity 132 and the power cavity 134 for locking engagement with the corresponding adjacent signal harness cartridge 122 and power harness cartridge 124. In other particular embodiments, the separating wall 156 may not include any locking rails 160, but rather the housing walls 130 associated with both the first and second sides 146, 148 may include locking rails 160. In other embodiments, such as when multiple separating walls are provided, each separating wall may include locking rails 160.

The signal harness cartridge 122 includes a dielectric body 200 holding the signal terminals 126. In the illustrated embodiment, the dielectric body 200 is generally box-shaped having a rectangular cross-section; however the dielectric body 200 may have other shapes in alternative embodiments. The dielectric body 200 of each signal harness cartridge 122 has a top 204, a bottom 206, a front 208, a rear 210 and opposite sides 212, 214. The dielectric body 200 includes signal terminal channels 216 extending therethrough that receive corresponding signal terminals 126. The signal terminal channels 216 are open at the front 208 and at the rear 210. The cables extend from the rear 210. The signal terminals 126 are loaded into the signal terminal channels 216 from the rear 210. The header terminals 112 are configured to be loaded into the signal terminal channels 216 through the front 208 for mating with the signal terminals 126.

In an exemplary embodiment, the signal harness cartridge 122 has a locking slot 218 formed in the second side 214 of the dielectric body 200. The signal harness cartridge 122 includes a locking rail 220 extending from the first side 212. However, in alternative embodiments, the locking slot 218 may be formed in the first side 212 and the locking rail 220 may extend from the second side 214. In other alternative embodiments, at least some of the signal harness cartridges 122, such as the outermost signal harness cartridge 122 that is configured to be positioned adjacent the separating wall 156, does not include a locking rail 220. The locking rails 220 are protrusions or extensions that extend outward from the corresponding side 212. The locking rails 220 may be elongated and may extend vertically for any desired length between the top 204 and the bottom 206 (e.g., parallel to the front 208 and/or the side 212). The locking rails 220 may be rectangular in cross-section, or alternatively may have any desired shape for serving the desired locking function.

The locking slot 218 is configured to receive the locking rail 220 of the adjacent signal harness cartridge 122 in the stack, or alternatively, may receive the locking rail 160 extending from the housing wall 130 into the signal cavity 132. The locking rails 160 or 220 are used to lock the signal terminals 126 in the dielectric body 200 of the corresponding signal harness cartridge 122. For example, as described in further detail below, the locking rails 160 or 220 are configured to be positioned behind a surface of the signal terminals 126 to block rearward movement or removal of the signal terminals 126 from the dielectric body 200. The locking rails 160 and 220 may be held in the locking slots 218 by an interference fit. The locking rails 160 and 220 may be used to secure the signal harness cartridge 122 in the signal cavity 132. Optionally, the locking rail 160 and 220 may have a dovetail shape.

In an exemplary embodiment, the locking slot 218 is open at the top 204. The locking slot 218 may receive the corresponding locking rail 160 or 220 by loading the locking rail 160 or 220 into the locking slot 218 in a loading direction, such as in an upward direction. In an exemplary embodiment, each of the signal harness cartridges 122 are coupled together into a stack with the locking rails 220 of the signal harness cartridges 122 being received in the locking slots 218 of corresponding adjacent signal harness cartridges 122 and then the stack is loaded into the signal cavity 132 as a unit. The signal harness cartridges 122 are arranged side-by-side in the stack with the sides 212, 214 of adjacent signal harness cartridges 122 touching each other. In the illustrated embodiment, the separating wall 156 includes a slot 222 that receives the locking rail 220 of the outermost, adjacent signal harness cartridge 122.

The power harness cartridge 124 includes a dielectric body 230 holding the power terminals 128. In the illustrated embodiment, the dielectric body 230 is generally box-shaped having a rectangular cross-section; however the dielectric body 230 may have other shapes in alternative embodiments. The dielectric body 230 of the power harness cartridge 124 has a top 234, a bottom 236, a front 238, a rear 240 and opposite sides 242, 244. The dielectric body 230 includes power terminal channels 246 extending therethrough that receive corresponding power terminals 128. The power terminal channels 246 are open at the front 238 and at the rear 240. The cables extend from the rear 240. The power terminals 128 are loaded into the power terminal channels 246 from the rear 240. The header terminals 112 are configured to be loaded into the power terminal channels 246 through the front 238 for mating with the power terminals 128.

In an exemplary embodiment, the power harness cartridge 124 has a locking slot 248 formed in the second side 244 of the dielectric body 230. However, in alternative embodiments, the locking slot 248 may be formed in the first side 242. Optionally, the power harness cartridge 124 may include a locking rail similar to the locking rail 220, such as when multiple power harness cartridges 124 are to be arranged together or when the power harness cartridge 124 is arranged adjacent one of the signal harness cartridges 122.

The locking slot 248 is configured to receive the power locking rail 160 extending into the power cavity 134 from the separating wall 156. However in alternative embodiments, the locking slot 248 may be arranged to receive one of the locking rails 160 extending from the housing wall 130 at the first side 146 or one of the locking rails 220 extending from one of the signal harness cartridges 122 or from a locking rail extending from an adjacent power harness cartridge 124. The locking rail 160 is used to lock the power terminals 128 in the dielectric body 230 of the power harness cartridge 124. For example, as described in further detail below, the locking rail 160 is configured to be positioned behind a surface of the power terminals 128 to block rearward movement or removal of the power terminals 128 from the dielectric body 230.

In an exemplary embodiment, the locking slot 248 is open at the top 234. The locking slot 248 may receive the locking rail 160 by loading the power harness cartridge 124 into the power cavity 134 through the bottom 142 of the harness housing 120, such as in an upward direction. The locking rail 160 may be held in the locking slot 248 by an interference fit. The locking rail 160 may be used to secure the power harness cartridge 124 in the power cavity 134. Optionally, the locking rail 160 may have a dovetail shape.

In an exemplary embodiment, various power harness cartridges 124 may be provided that define a family of power harness cartridges 124. The family of power harness cartridges 124 may be rated for different current carrying capacities. The power harness cartridges 124 may differ from each other in that the power terminals 128 have different current carrying capacity, such as by having different widths or thicknesses, as compared to power terminals 128 of other power harness cartridges 124. Different types of power harness cartridges 124 may be manufactured and rated based on the cumulative current carrying capacity of the harness power terminals 128.

Figure 6:
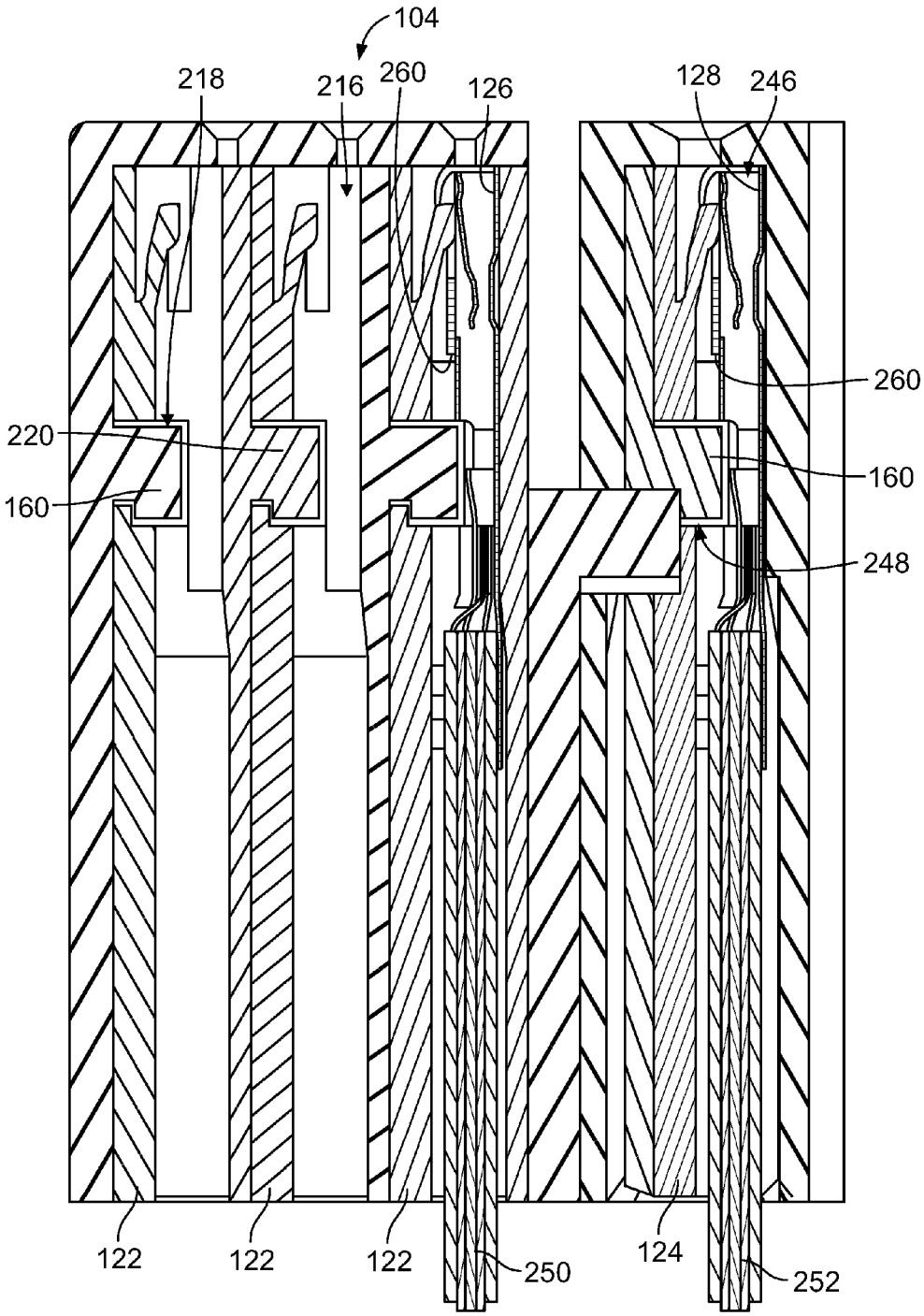
FIG. 6 is a cross-sectional view of a portion of the harness connector.

FIG. 6 is a cross-sectional view of a portion of the harness connector 104. The signal terminals 126 and power terminals 128 are shown loaded into respective signal terminal channels 216 and power terminal channels 246 of the signal harness cartridges 122 and the power harness cartridge 124 with signal cables 250 and power cables 252 extending therefrom. The locking rails 160 and 220 are loaded into corresponding locking slots 218, 248 in blocking positions directly behind the signal and power terminals 126, 128 to secure the signal and power terminals 126, 128 in the harness cartridges 122, 124.

The terminals 126, 128 have blocking surfaces 260, which may be rearward facing. The blocking surfaces 260 are positioned immediately forward of the locking slots 218, 248. The locking rails 160, 220 are positioned in the locking slots 218, 248 behind the blocking surfaces 260. The locking rails 160, 220 hold the axial positions of the terminals 126, 128 in the terminal channels 216, 246. The locking rails 160, 220 stop rearward movement of the terminals 126, 128 in the terminal channels 216, 246.

Optionally, the locking rails 160, 220 may be used as terminal position assurance devices, assuring that the terminals 126, 128 are fully loaded into the terminal channels 216, 246 during assembly. For example, when one of the terminals 126, 128 is not fully loaded, the locking rails 160, 220 may not be able to be loaded into the corresponding locking slot 218, 248, giving an indication to the assembler that such terminal(s) 126, 128 is not fully loaded into the corresponding terminal channel 216, 246.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A harness connector comprising:

a harness housing having a signal cavity and a power cavity defined by housing walls, at least one of the housing walls having a locking rail extending therefrom into the corresponding signal cavity or power cavity;

a plurality of signal harness cartridges received in the signal cavity, each signal harness cartridge holding a plurality of signal terminals terminated to ends of signal cables, each signal harness cartridge having a locking slot configured to receive a corresponding locking rail in a position directly behind the signal terminals to engage and block removal of the signal terminals to secure the signal terminals in the signal harness cartridge; and a power harness cartridge received in the power cavity, the power harness cartridge holding a plurality of power terminals terminated to ends of power cables, the power harness cartridge having a locking slot configured to receive a corresponding locking rail in a position directly behind the power terminals to engage and block removal of the power terminals to secure the power terminals in the power harness cartridge.

2. The harness connector of claim 1, wherein at least some of the plurality of signal harness cartridges include locking rails extending therefrom that are received in locking slots of corresponding adjacent signal harness cartridges.

3. The harness connector of claim 1, wherein each signal harness cartridge includes a dielectric body having a top, a bottom, a front, a rear, and opposite sides, the locking slots being provided on one of the sides and being open at the top, the corresponding locking rail being loaded into the locking slot through the top.

4. The harness connector of claim 1, wherein the signal harness cartridges are identical.

5. The harness connector of claim 1, wherein each signal harness cartridge includes a dielectric body having a top, a bottom, a front, a rear, and opposite sides, the dielectric body having signal terminal channels open at the front and the rear, the signal terminals being loaded into the signal terminal channels through the rear, the signal cables extending from the rear, the signal terminal channels receiving header terminals of a header connecter through the front.

6. The harness connector of claim 1, wherein the signal terminals include blocking surfaces, the locking rail received in the locking slot blocking the blocking surfaces of each of the signal terminals to block the signal terminals from moving rearward in the signal harness cartridge.

7. The harness connector of claim 1, wherein the locking rail comprises a signal locking rail extending from the corresponding housing wall into the signal cavity and a power locking rail extending from the corresponding housing wall into the power cavity.

8. The harness connector of claim 1, wherein each signal harness cartridge comprises a locking rail, the signal harness cartridges being pre-assembled into a stack with the locking rails of the signal harness cartridges being received in locking slots of corresponding adjacent signal harness cartridges, the stack of signal harness cartridges being loaded into the signal cavity as a unit.

9. A harness connector comprising:

a harness housing having a signal cavity and a power cavity defined by housing walls, the harness housing having a signal locking rail extending from the corresponding housing wall into the signal cavity, the harness housing having a power locking rail extending from the corresponding housing wall into the power cavity;

a plurality of signal harness cartridges received in the signal cavity and arranged side-by-side, each signal harness cartridge holding a plurality of signal terminals terminated to ends of signal cables, each signal harness cartridge having a first side and a second side, the first side having a signal locking rail extending outward therefrom, the second side having a signal locking slot configured to receive a corresponding signal locking rail from either the harness housing or the adjacent signal harness cartridge in a position directly behind the signal terminals to engage and block removal of the signal terminals to secure the signal terminals in the signal harness cartridge; and a power harness cartridge received in the power cavity, the power harness cartridge holding a plurality of power terminals terminated to ends of power cables, the power harness cartridge having a locking slot receiving the power locking rail in a position directly behind the power terminals to engage and block removal of the power terminals to secure the power terminals in the power harness cartridge.

10. The harness connector of claim 9, wherein each signal harness cartridge includes a dielectric body having a top, a bottom, a front and a rear, the locking slots being open at the top, the corresponding locking rail being loaded into the locking slot through the top.

11. The harness connector of claim 9, wherein each signal harness cartridge includes a dielectric body having a top, a bottom, a front and a rear, the dielectric body having signal terminal channels open at the front and the rear, the signal terminals being loaded into the signal terminal channels through the rear, the signal cables extending from the rear, the signal terminal channels receiving header terminals of a header connecter through the front.

12. The harness connector of claim 9, wherein the signal terminals include blocking surfaces, the locking rail received in the locking slot blocking the blocking surfaces of each of the signal terminals to block the signal terminals from moving rearward in the signal harness cartridge.

13. The harness connector of claim 9, wherein the signal harness cartridges are pre-assembled into a stack with the locking rails of the signal harness cartridges being received in locking slots of corresponding adjacent signal harness cartridges, the stack of signal harness cartridges being loaded into the signal cavity as a unit.

14. A harness connector comprising:

a harness housing having a signal cavity and a power cavity defined by housing walls, the harness housing having a front wall forward of the signal cavity, the front wall having a plurality of signal terminal channels therethrough;

a signal harness cartridge received in the signal cavity, the signal harness cartridge holding a plurality of signal terminals terminated to ends of signal cables, the signal terminals being aligned with corresponding signal terminal channels and the signal terminal channels being configured to guide header terminals of a header connector into mating engagement with the signal terminals;

a first power harness cartridge holding a plurality of power terminals terminated to ends of power cables; and a second power harness cartridge holding a plurality of power terminals terminated to ends of power cables, the power terminals of the second power harness cartridge having a different cumulative current carrying capacity than the power terminals of the first power harness cartridge;

wherein the power cavity selectively receives either the first power harness cartridge or the second power harness cartridge to change the current carrying capacity of the harness connector.

15. The harness connector of claim 14, wherein at least some of the power terminals of the second power harness cartridge are wider than the power terminals of the first power harness cartridge to increase the current carrying capacity of the second power harness cartridge as compared to the first power harness cartridge.

16. The harness connector of claim 14, wherein the first power harness cartridge includes a dielectric body holding the power terminals of the first power harness cartridge, the second power harness cartridge includes a dielectric body holding the power terminals of the second power harness cartridge, the dielectric body of the first power harness cartridge being sized and shaped substantially the same as the dielectric body of the second power harness cartridge such that the first power harness cartridge and second power harness cartridge are configured to be alternately loaded into the power cavity.

17. The harness connector of claim 14, wherein the harness housing includes a front, a rear, a top, a bottom, and opposed first and second sides, the harness housing including a separating wall parallel to and positioned between the first and second sides, the power cavity being defined between the separating wall and the first side, the signal cavity being defined between the separating wall and the second side, wherein, when the first power harness cartridge is loaded in the power cavity, the first power harness cartridge engages the separating wall and the first side, and wherein, when the second power harness cartridge is loaded in the power cavity, the second power harness cartridge engages the separating wall and the first side.

18. The harness connector of claim 14, wherein at least some of the plurality of signal harness cartridges include locking rails extending therefrom that are received in locking slots of corresponding adjacent signal harness cartridges.

19. The harness connector of claim 14, wherein each signal harness cartridge includes a dielectric body having a top, a bottom, a front, a rear, and opposite sides, locking slots being provided on one of the sides and being open at the top, locking rails being loaded into the locking slot through the top.

20. The harness connector of claim 14, wherein each signal harness cartridge comprises a locking rail, the signal harness cartridges being pre-assembled into a stack with the locking rails of the signal harness cartridges being received in locking slots of corresponding adjacent signal harness cartridges, the stack of signal harness cartridges being loaded into the signal cavity as a unit.

* * * * *